US010912374B2

(12) United States Patent
Hopple

(10) Patent No.: US 10,912,374 B2
(45) Date of Patent: Feb. 9, 2021

(54) FLEXIBLE FOLDING SLING

(71) Applicant: Patrick Russell Hopple, Miami, FL (US)

(72) Inventor: Patrick Russell Hopple, Miami, FL (US)

( * ) Notice: Subject to any disclaimer, the term of this patent is extended or adjusted under 35 U.S.C. 154(b) by 0 days.

(21) Appl. No.: 15/319,841

(22) PCT Filed: Jun. 19, 2015

(86) PCT No.: PCT/US2015/036831
§ 371 (c)(1),
(2) Date: Dec. 19, 2016

(87) PCT Pub. No.: WO2015/196173
PCT Pub. Date: Dec. 23, 2015

(65) Prior Publication Data

US 2017/0119133 A1 May 4, 2017

Related U.S. Application Data

(60) Provisional application No. 61/998,134, filed on Jun. 19, 2014.

(51) Int. Cl.
*A45F 3/14* (2006.01)
*A45C 13/30* (2006.01)
(Continued)

(52) U.S. Cl.
CPC ..... *A45F 3/14* (2013.01); *A45C 13/30* (2013.01); *A45F 5/1046* (2013.01);
(Continued)

(58) Field of Classification Search
CPC .... A45F 3/14; A45F 5/1046; A45F 2003/142; A45F 2005/1013; A45C 13/30
(Continued)

(56) References Cited

U.S. PATENT DOCUMENTS 3,278,097 A * 10/1966 Duckworth ..... A63C 11/025 294/147
3,307,538 A 3/1967 Groll
(Continued)

FOREIGN PATENT DOCUMENTS

FR 2751184 A1 1/1998
FR 2771607 A3 6/1999

OTHER PUBLICATIONS

International Search Report dated Sep. 24, 2015 for PCT/US15/36381.

(Continued)

*Primary Examiner* — Peter N Helvey
(74) *Attorney, Agent, or Firm* — Fielt Intellectual Property Law; Paul D. Bianco; Gary S. Winer

(57) ABSTRACT

A flexible folding sling includes a flexible elongate preform strap having first and second ends, each of the first and second ends folded inward toward a strap center to form respective first and second loops. The first and second ends are fastened to the strap center with each of the first and second loops having a half-twist such that each of the first and second loops is a tear-shaped Mobius loop. The flexible folding sling assists a user in carrying bag(s) having handles, or other objects that include handles or like structure. When used to carry bags, the sling can be configured as a hand-sling, a shoulder-sling or a back-sling. When used as a hand-sling, the sling engages the user's wrist in a secure and comfortable manner. This prevents load transmission through the easily tired hand muscles and ligaments, extending the amount of time the user can carry a load. This also allows the user to maintain use of her hand and fingers while the sling is used.

18 Claims, 11 Drawing Sheets

(51) Int. Cl.
*A45F 5/10* (2006.01)
*A45C 13/22* (2006.01)

(52) U.S. Cl.
CPC .. *A45C 2013/223* (2013.01); *A45C 2013/303* (2013.01); *A45F 5/10* (2013.01); *A45F 2003/142* (2013.01); *A45F 2005/1013* (2013.01)

(58) Field of Classification Search
USPC ..... 224/578
See application file for complete search history.

(56) References Cited

U.S. PATENT DOCUMENTS 4,911,347 A * 3/1990 Wilhite ..... A45F 3/14 224/251
D311,232 S * 10/1990 Drennan ..... D21/692
5,044,538 A 9/1991 Bader
5,370,286 A * 12/1994 Newman ..... A45F 3/14 119/857
5,437,401 A 8/1995 Seltzer
5,603,545 A 2/1997 Benson et al.
5,624,388 A * 4/1997 Lehr ..... A61F 5/0118 602/20
5,695,101 A * 12/1997 Frietze ..... A45F 3/14 224/250
6,076,874 A * 6/2000 Lovette ..... A45F 5/10 294/150
6,142,547 A * 11/2000 Bowerman ..... A01K 1/0236 224/921
6,182,875 B1 * 2/2001 Fareghi ..... A45F 3/14 224/258
D457,725 S * 5/2002 Parsons ..... D3/327
6,447,037 B1 * 9/2002 Crouch ..... B65D 33/14 294/149
D471,006 S * 3/2003 French ..... D3/221
6,637,077 B2 * 10/2003 Doty ..... B60P 3/079 24/298
D508,323 S * 8/2005 Douglas ..... D3/328
D509,065 S * 9/2005 Koenig ..... D3/327
D620,252 S * 7/2010 Keels ..... D3/247
7,854,231 B1 * 12/2010 Mostad ..... E05B 75/00 128/869
8,033,728 B1 * 10/2011 Shatwell ..... B65D 33/1616 24/30.5 P
D678,434 S * 3/2013 Hughes ..... D21/662
8,413,863 B2 * 4/2013 Bergman ..... A45C 3/06 224/409
8,616,600 B2 * 12/2013 Owen ..... A63C 11/025 224/917
8,746,769 B2 * 6/2014 Owen ..... A63C 11/021 224/917
9,480,327 B2 * 11/2016 Moreau ..... A45F 5/00
9,561,397 B2 * 2/2017 Zaki ..... A63B 21/0552
9,635,925 B2 * 5/2017 Moreau ..... A45F 5/00
2015/0320191 A1 * 11/2015 Stevens ..... A45F 5/10 294/149

OTHER PUBLICATIONS

Written Opinion dated Sep. 24, 2015 for PCT/US15/36381.
Supplementary European Search Report dated Dec. 20, 2017 for EP patent application No. 15809201.5.
International Preliminary Report Written Opinion for PCT/US2015/036831, dated Dec. 2, 2016.
Response filed Jun. 19, 2018 for EP patent application No. 15809201.5.
European Communication pursuant to rule 71(3) EPC—Intent to Grant, dated Feb. 21, 2019 for EP patent application No. 15809201.5.
Response filed Jun. 11, 2019 for EP patent application No. 15809201.5.

* cited by examiner

FLEXIBLE FOLDING SLING

FIELD OF THE DISCLOSURE

The disclosure relates to a flexible folding sling and methods of using the flexible folding sling.

BACKGROUND

Individuals commonly need to carry a variety of objects; however, there is a limit to how many objects that can be comfortably carried. To overcome this limit, there are many devices to increase the number of objects that an individual can carry.

One such device is a plastic bag with integrated handles, typically used in grocery stores and other retail outlets. Such plastic bags allow individuals to carry multiple items within the bag by using only the hand to grasp the handles. Plastic bags are either easily stored or simply thrown away. Nevertheless, plastic bags with handles still have limitations. For example, while a lightweight plastic bag can be easy to carry by hand, carrying a heavy plastic bag by hand can be uncomfortable and even painful. The weight of the objects in the bag can cause the bag's handles to apply a significant amount of pressure to the individual's hand. This problem is greatly exacerbated when the individual is attempting to carry multiple bags of any significant weight. The discomfort and/or pain caused by the weight of the bags only increases with the amount of time the bags must be carried. Thus, using a plastic bag to carry a heavy weight over a long period of time is not a viable option.

Additionally, while carrying heavy bags by hand may cause discomfort or pain to some individuals, other individuals simply do not have the strength to carry items by hand. For instance, many older people have a decreased strength and cannot carry items that are a routine part of the life, such as shopping or grocery store bags. Further, some individuals cannot carry certain items because of a handicap or deformity. Nevertheless, such individuals in particular, need to be able to carry such items in order to remain independent from constant help. Thus, a portable device that is easily compacted for storage and that can be used to carry multiple items is desired.

SUMMARY OF THE DISCLOSURE

The disclosed flexible folding sling assists a user in a variety of manual tasks, including carrying multiple bags having handles, particularly plastic grocery bags. The sling may also be used for carrying other objects that include handles or like structure and for securing a user's grip to other projections, such as safety support bars in trains, buses and the like.

When used to carry bags, the sling is configured as a hand-sling, a shoulder-sling, or a back-sling.

When used as a hand-sling, the sling engages the user's wrist in a secure and comfortable manner. This prevents load transmission through the easily tired small muscles and ligaments of the hand, extending the amount of time the user can carry a load. This also allows the user to maintain use of his or her hand and fingers while the sling is used.

Additionally, when the sling is used as a hand-sling for plastic grocery bags, the sling orients the bags to facilitate bag transport.

In one embodiment, the flexible folding sling is for carrying and transporting at least one bag or similar object, each of the at least one bag having a handle. The flexible folding sling comprises a flexible elongate preform strap having first and second ends, each of the first and second ends folded inward toward a strap center to form respective first and second loops. The first and second ends are fastened to the strap center. Each of the first and second loops has a half-twist such that each of the first and second loops is a tear-shaped Mobius loop.

The first and second loops can be provided with a securing member for releasably securing the first loop to the second loop. In an exemplary embodiment, the securing member includes a hook fastener patch on a side of the first loop facing away from the strap center and a loop fastener patch on a side of the second loop facing toward the strap center.

The strap can have a substantially uniform width along the entire length of the strap.

Depending on the desires of the user, the flexible folding sling is configurable as a hand-sling and a shoulder-sling.

When configured as a hand-sling, the strap has a width and a length such that the strap extends through each of the handles of one or more bags or like objects. The first and second loops are releasably secured together by the hook fastener patch and the loop fastener patch.

In an exemplary embodiment, the hand-sling has a top opening with a top opening axis and a bottom opening with a bottom opening axis. Each of the handles of the bag(s) is captured in the bottom opening so that each of the handles is proximate the strap center. The top opening axis and the bottom opening axis are offset from each other by approximately 90 degrees.

The top opening can have a concave interior engagement surface formed by an inner surface of a rounded end of the first loop, with the concave interior engagement surface adapted to conform to a wrist of a user.

A bottom portion of the bottom opening can have a capture channel, with the capture channel configured and dimensioned to orient each of the handles of the bag(s) such that multiple bags are maintained in a single-file bag group.

When configured as a shoulder-sling, the strap has a width and a length such that the strap extends through each of the handles of the at least one bag or like object. The first loop is passed through the second loop to capture each of the handles of the bag(s).

When configured as a back-sling, first and second flexible folding slings are used. The first loop of the first flexible folding sling is passed through the second loop of the second flexible folding sling and the first loop of the first flexible folding sling is passed through the second loop of the first flexible folding sling.

Also disclosed is a method of carrying and transporting at least one bag or like object, each of said at least one bag having a handle. The method comprises extending the strap of the flexible folding sling through each of the handles; and releasably securing the first and second loops together with the hook fastener patch and the loop fastener patch.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein.

DETAILED DESCRIPTION

Figure 1:
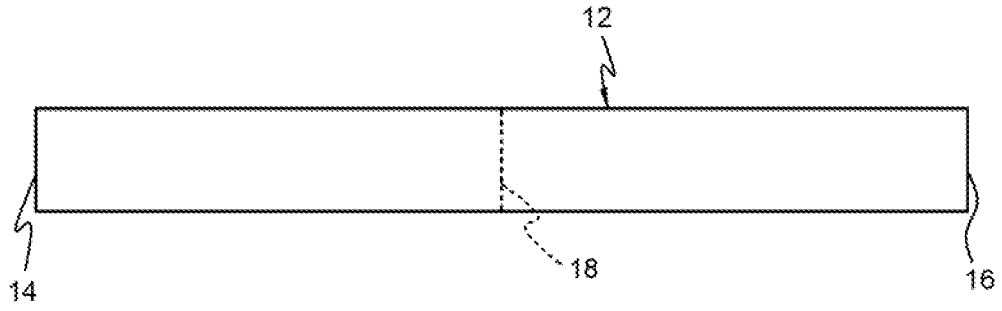
FIG. 1 is a top view of a preform strap for making a sling.
Figure 2:
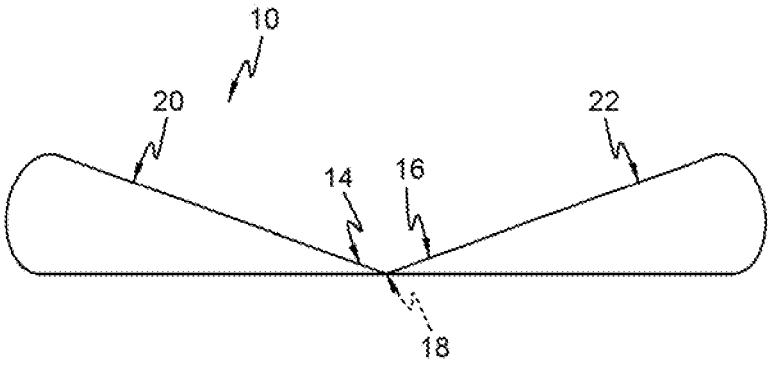
FIG. 2 is a representational side view of the sling.
Figure 3:
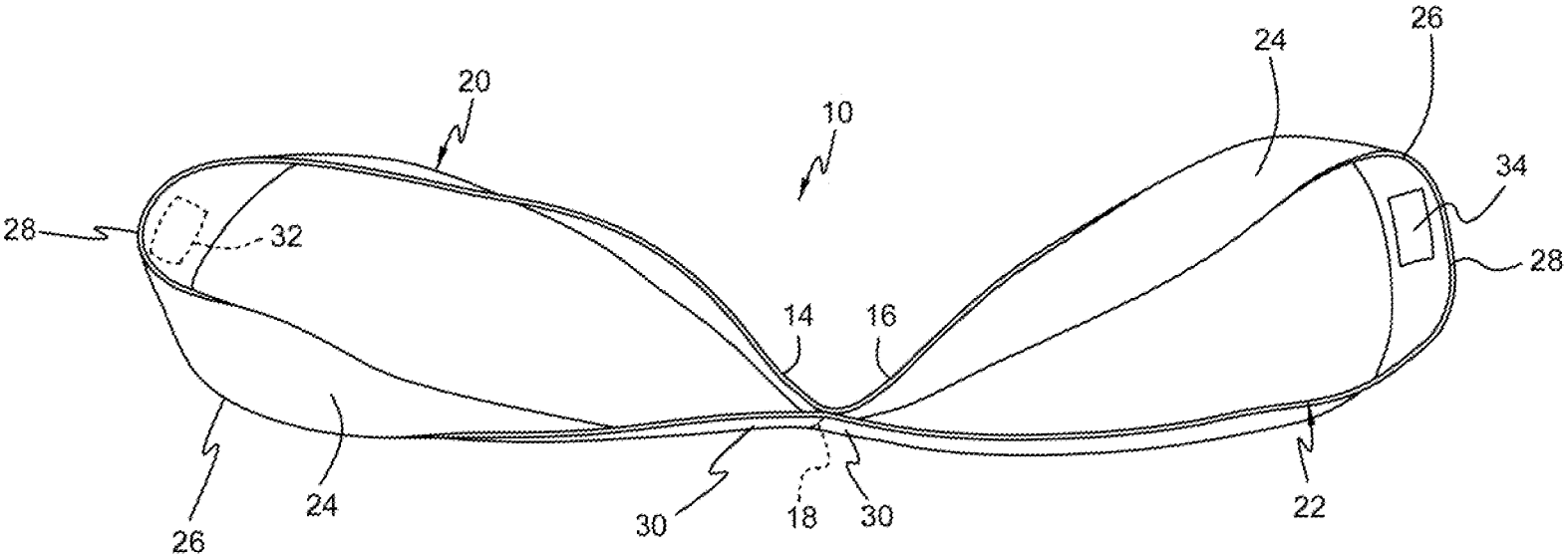
FIG. 3 is a top view of the sling.
Figure 4:
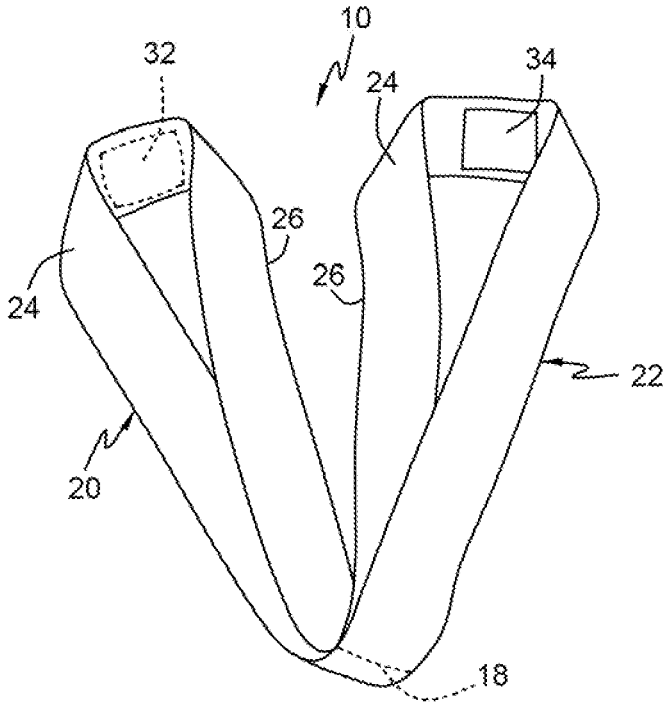
FIG. 4 is a top view of a partially folded sling.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Initially with reference primarily to FIGS. 1-4 and 19, a flexible folding sling 10 is made up of a flexible elongate preform strap 12 having opposed ends 14 and 16. The strap may be a flexible band having a uniform width along the length of the strap. The disclosure contemplates that the width may not be constant along the length of the strap. Exemplary materials for sling 10 include a sturdy textile fabric such as woven nylon or a like material. Any material that has sufficient flexibility and strength can be used.

Strap 12 is folded inward so that ends 14 and 16 are brought to strap center 18 to form loops 20 and 22 at either end of sling 10. Ends 14 and 16 are fastened to strap center 18 by sewing, adhesives or other known attachment means.

Figure 19:
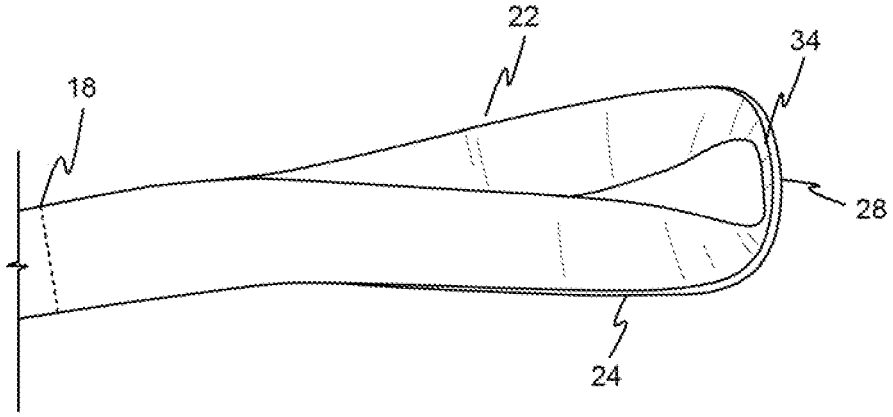
FIG. 19 is an enlarged view of one of the loops of the sling.

Before fastening ends 14 and 16 at strap center 18, a half-twist 24 is placed in each loop 20, 22. Half-twist 24 forms each loop into a tear-shaped Mobius strip or loop 26. Each Mobius loop 26 includes a rounded end 28 away from strap center 18 and a pointed end 30 proximate at strap center 18. Mobius loops 26 are joined together at strap center 18 to form sling 10. See FIG. 3. FIG. 19 is an enlarged view of loop 22.

Loop 20 may include a Velcro-type hook fastener patch 32 on the side of rounded end 28 facing away from center 18. Loop 22 may include a Velcro-type loop fastener patch 34 on the side of rounded end 28 facing toward center 18. Other releasable fastening mechanisms, such as a button, snap, etc., are contemplated.

Figure 16:
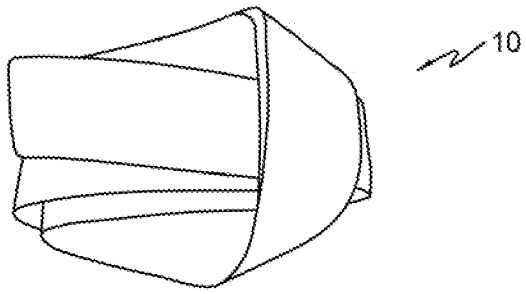
FIG. 16 is a view of the sling in a compacted folded state.

In use, the sling may be used as a hand-sling, a shoulder-sling, or a back-sling. Regardless of how sling 10 is used, prior to use or after use in storage, sling 10 can be easily folded for lightweight and pocket size storage. In particular, loops 20 and 22 can be brought together so that rounded ends 28 of loops 20 and 22 are in contact. If desired, loops 20 and 22 may be secured together by engaging hook fastener patch 32 onto loop fastener patch 34. Sling 10 is then folded by bringing center 18 into contact with the concave surface of loops 20 and 22. This compacted folded state is shown in FIG. 16.

Figure 5:
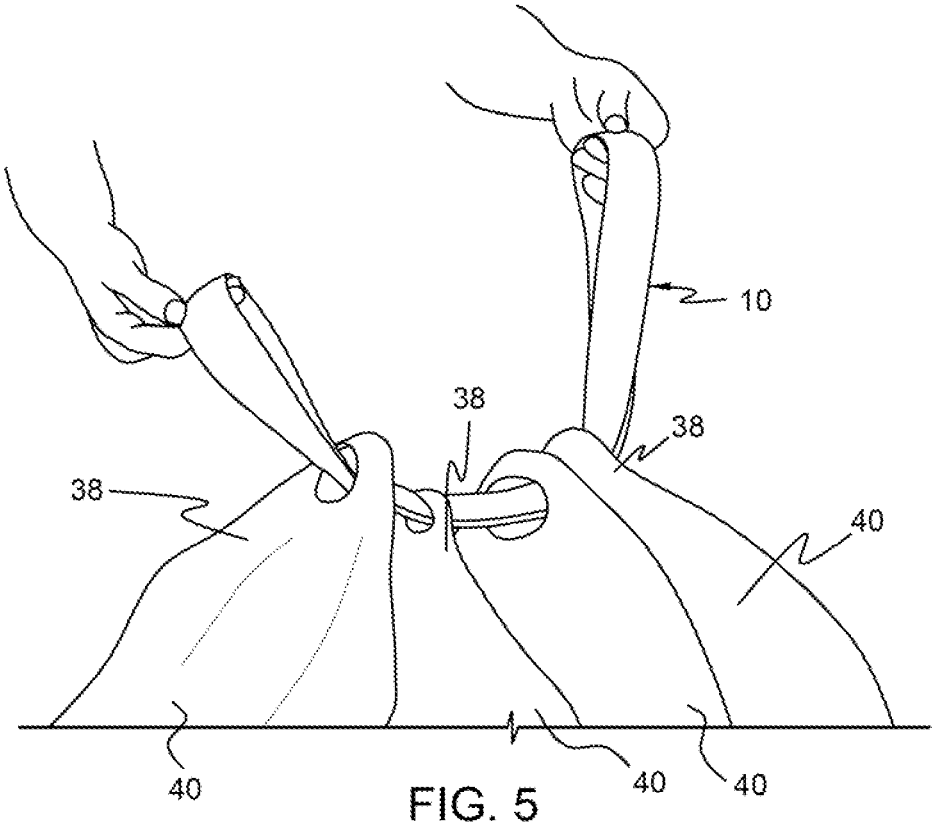
FIG. 5 is a side view of a sling extended through aligned grocery bag handle openings.
Figure 6:
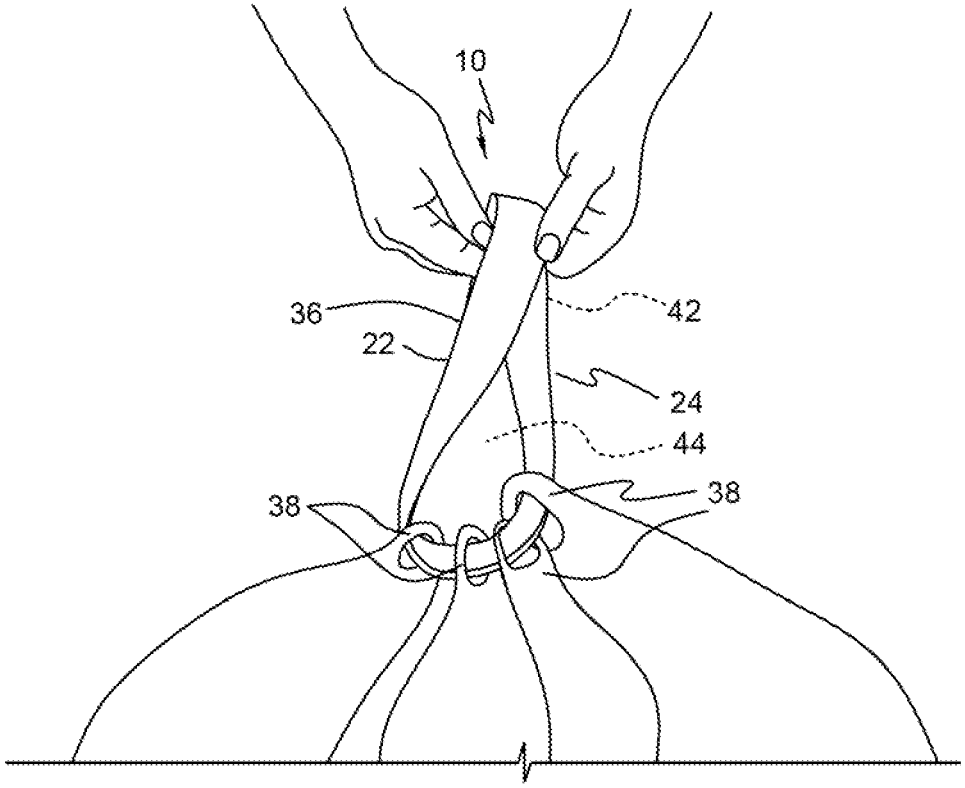
FIG. 6 is a side view of the sling being configured into a hang-sling.

Hand-sling 36 is shown in FIGS. 5-8. When used as a hand sling in one embodiment, sling 10 is first extended through the aligned handles 38 of one or more grocery bags 40 as shown in FIG. 5. Although specific reference is made to grocery bags, any similar object that has handles can be used with hand-sling 36. Hand-sling 36 is formed by bringing loops 20 and 22 together around handles 38 so that rounded ends 28 of loops 20 and 22 are in contact. See FIG. 6.

If desired, loops 20 and 22 may be secured together by engaging hook fastener patch 32 onto loop fastener patch 34.

Hand-sling 36 includes a top opening 42 and a bottom opening 44. Grocery bag handles 38 are captured in bottom opening 44 so that the handles are proximate strap center 18.

Top opening 42 has a top-opening axis 46 and bottom opening 44 has a bottom-opening axis 48. Axes 46 and 48 are offset to each other by approximately 90 degrees. See FIG. 8.

Figure 7:
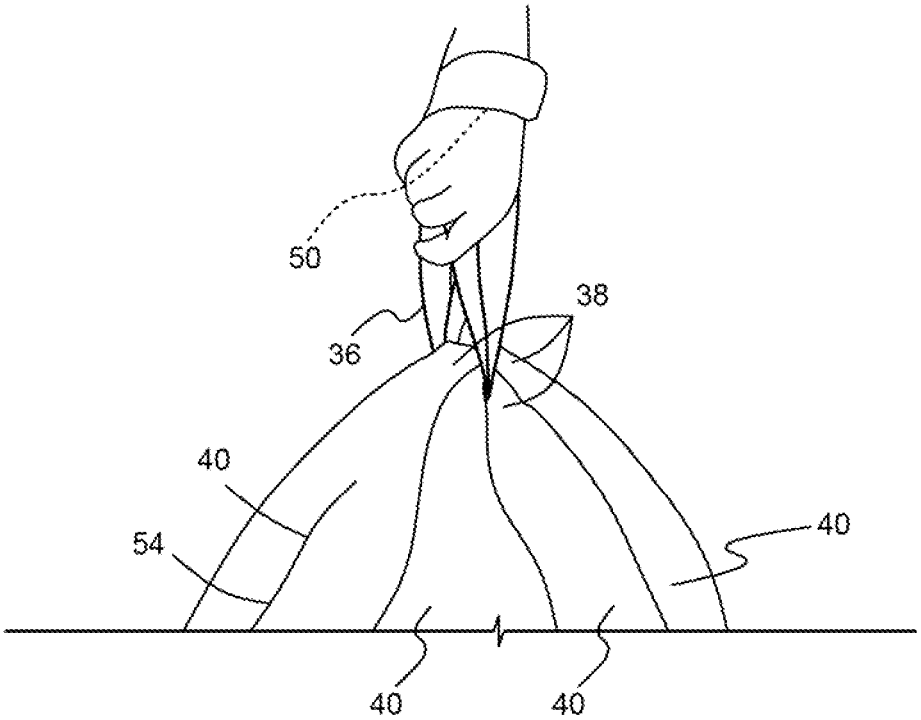
FIG. 7 is a side view of the hang-sling in use.
Figure 8:
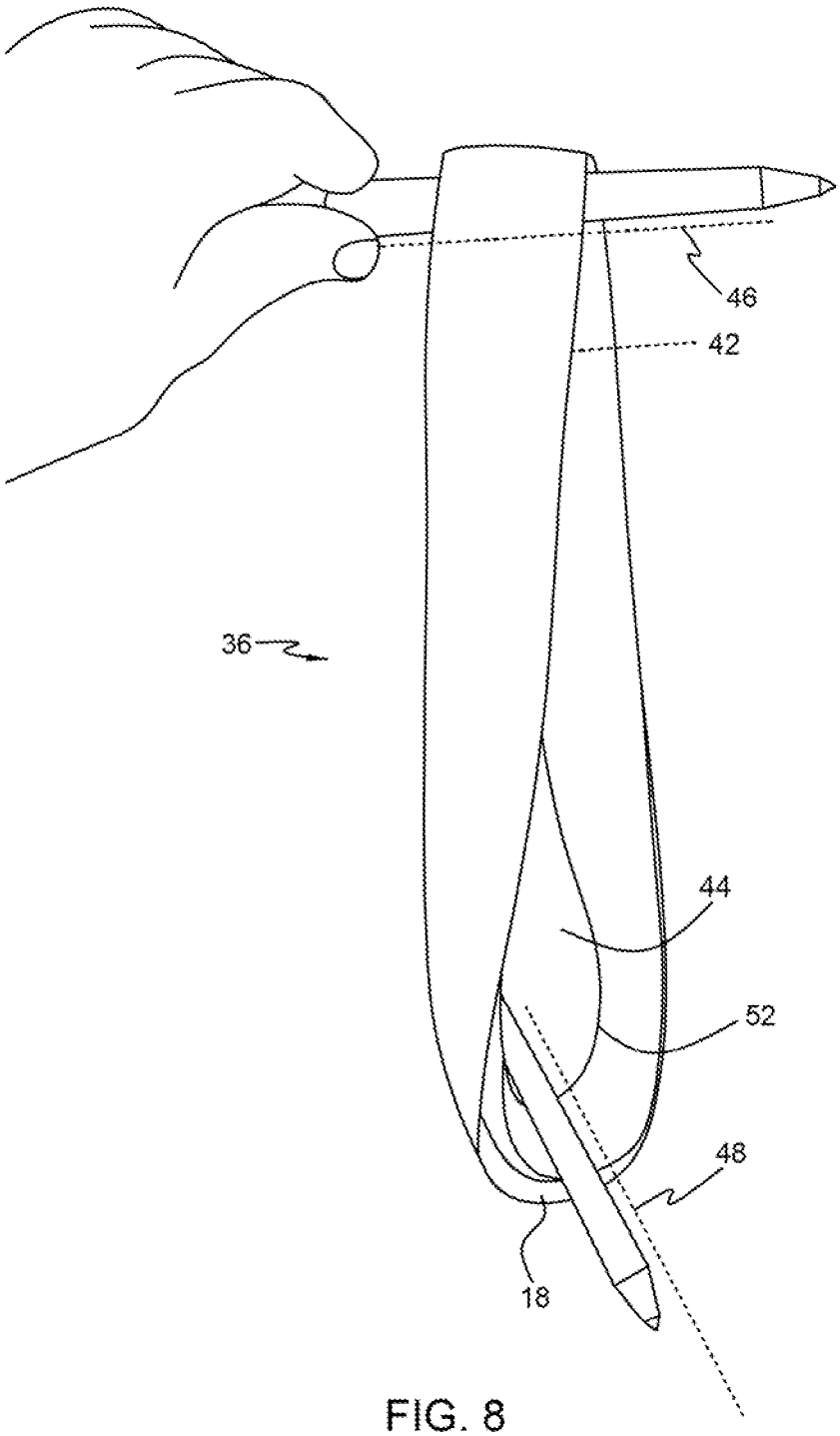
FIG. 8 is a view showing the hand-sling top and bottom openings.

Top opening 42 has a concave interior engagement surface 50 formed by the interior surface of rounded end 28 of loop 20. Surface 50 is located at the top of opening 42 and is adapted to conform to a user's wrist as shown in FIG. 7. Alternatively, a user may grip surface 50 by hand. Regardless of whether gripped by the wrist or hand, surface 50 rests ergonomically on the user, making contact with the most skin in the most comfortable way. This functionality results from the half-twists in loops 20, 22.

Bottom opening 44 has a narrow bag handle capture channel 52. Channel 52 is located along the bottom portion of opening 44 proximate strap center 18.

Figure 15:
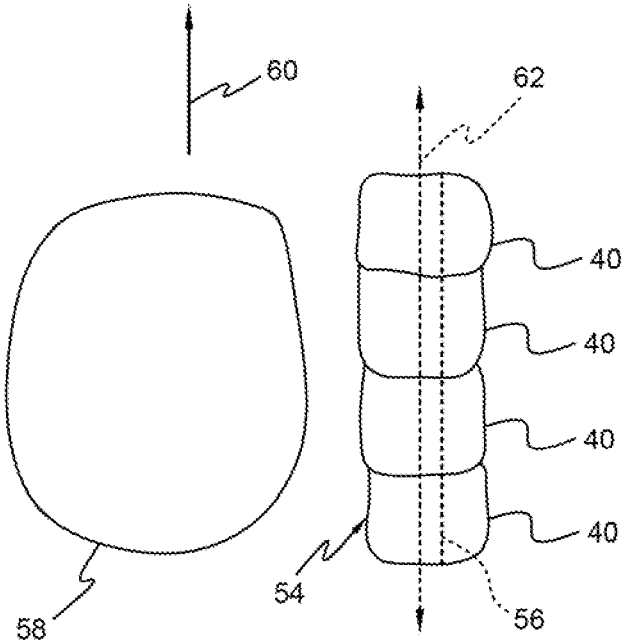
FIG. 15 is a representational top view of the hand sling in use.

In use as a hand sling, one or more handles 38 of bags 40 (or similar objects) are placed into hand-sling bottom opening 44 and a user's hand is placed into hand-sling top opening 42 so that their wrist engages surface 50. In one exemplary embodiment, to facilitate placing handles 38 on sling 10, one of loops 20, 22 can be releasably attached to a shopping cart (for example with a Carabineer Keychain) thereby facilitating threading the unattached end through bag handles 38 while still in the shopping cart. Regardless of whether attached to a shopping cart or not, bag handles 38 are oriented by channel 52 so that multiple grocery bags 40 are maintained in a single-file bag group 54 as shown in FIGS. 7 and 15. Bag group 54 has a group bag axis 56 extending along the multiple bags as shown in FIG. 15.

Perpendicularly offset top and bottom openings 42 and 44 and bag handle capture channel 52 facilitate transport of a bag group 54 as the user walks. As a user 58 walks in the direction of a line 60, the user's arm swings back and forth along a line 62 parallel with line 60 as a part of the body's natural gait. Hand-sling 36 allows group bag axis 56 to be maintained generally co-linearly with line 62 during walking. This prevents bags supported by the hand-sling from running into user 58 and hampering walking motion. See FIG. 15.

Figure 17:
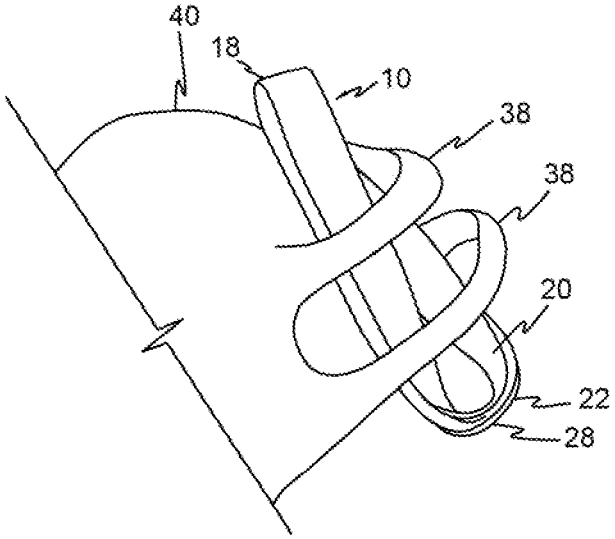
FIGS. 17 and 18 show use of the sling as a modified hand-sling.
Figure 18:
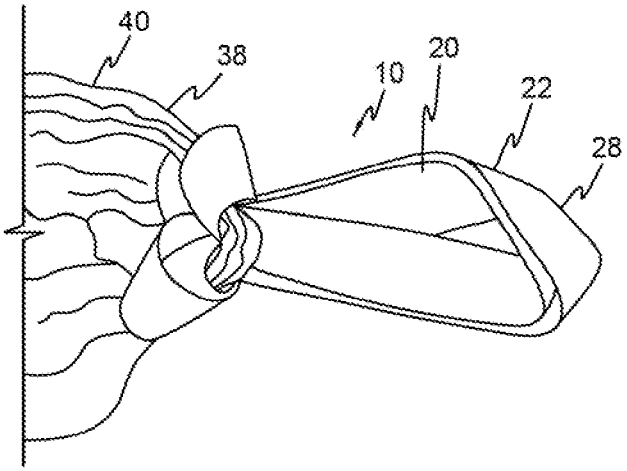

In a modified version of the hand-sling shown in FIGS. 17 and 18, sling 10 is inserted through the handles 38 of bag 40, with sling 10 in a partially folded condition with loops 20 and 22 brought together so that rounded ends 28 of loops 20 and 22 are in contact (FIG. 17). If desired, loops 20 and 22 may be secured together by engaging hook fastener patch 32 onto loop fastener patch 34. As shown in FIG. 18, the rounded ends 28 of loops 20 and 22 is passed through the loop near strap center 18. As with the other hand-sling, the user can grip with either the wrist or hand. This configuration is found to be particularly useful for reusable grocery bags, but other uses are contemplated.

Figure 9:
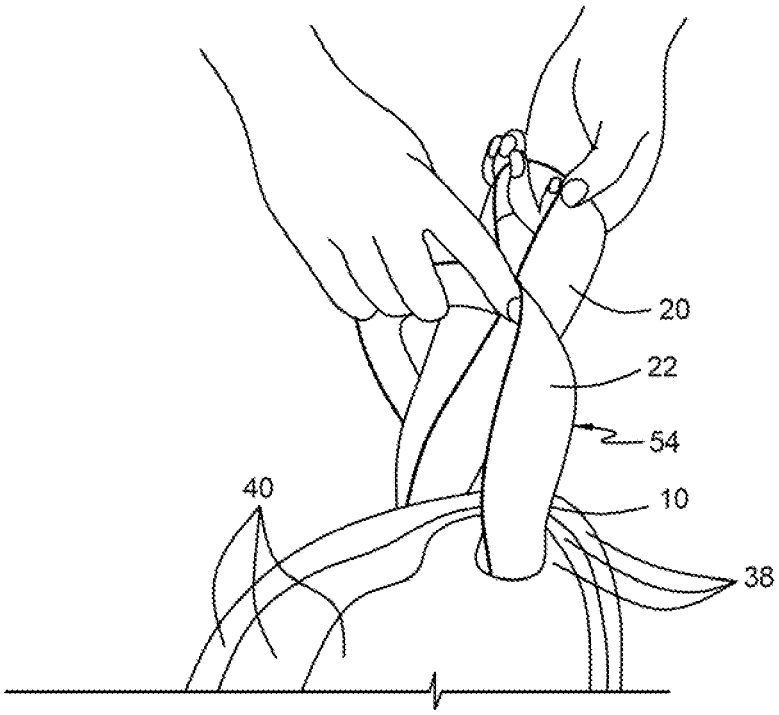
FIGS. 9 and 10 are views of the sling being configured into a shoulder-sling.
Figure 10:
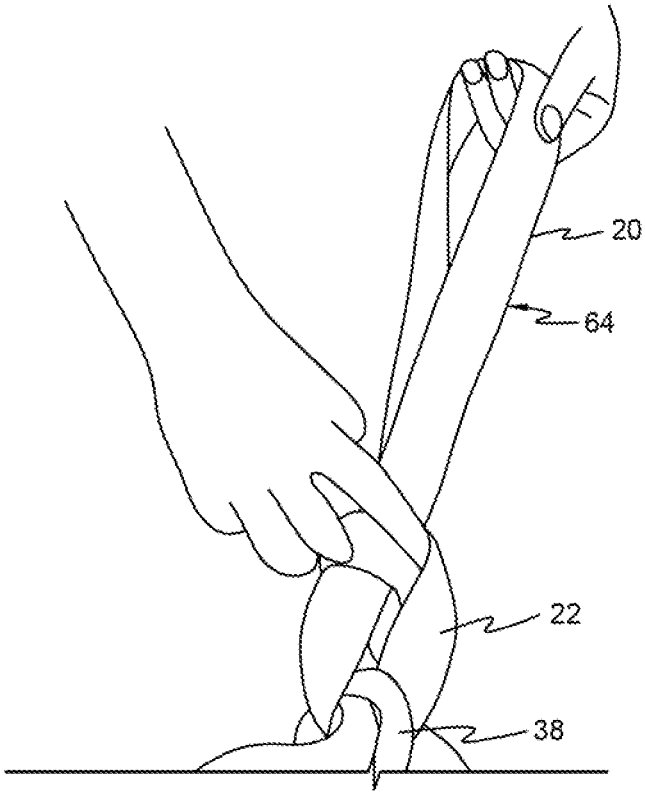
Figure 11:
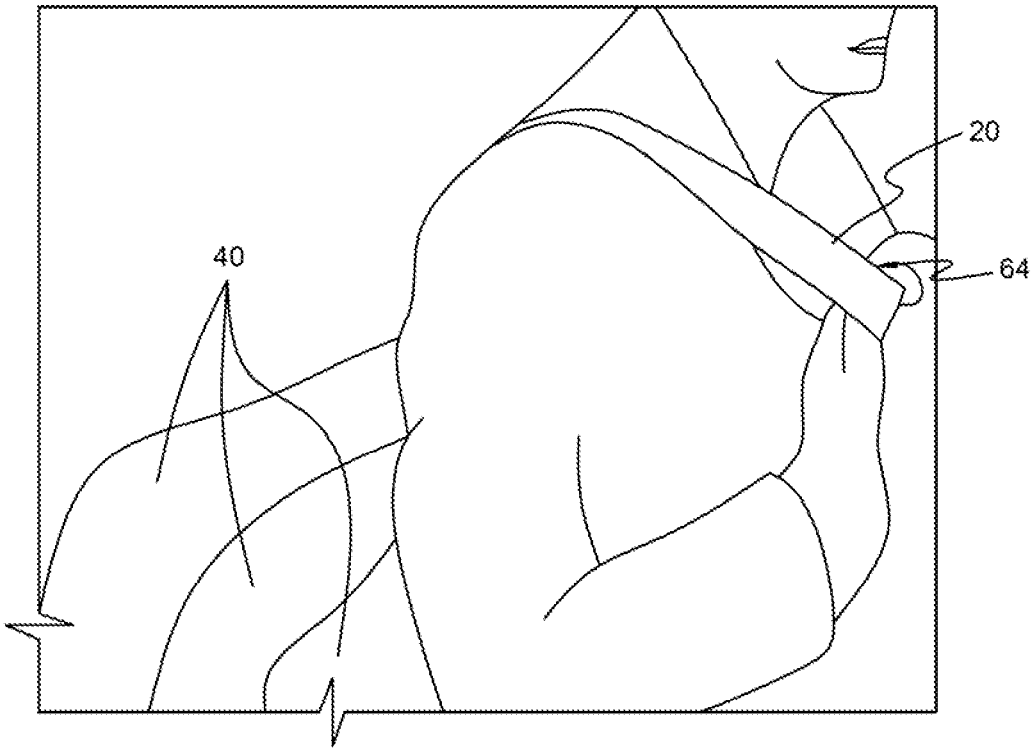
FIG. 11 is a view of the shoulder-sling in use.

Shoulder-sling 64 is shown in FIGS. 9-11. When used as a shoulder-sling, sling 10 is first extended through the aligned handles 38 of one or more grocery bags 40 as shown in FIG. 9. Although specific reference is made to grocery bags, any similar object that has handles can be used with shoulder-sling 64. Then loop 20 is passed though loop 22 to capture grocery bag handles 38 as shown in FIGS. 9 and 10 to secure bag handles 38. Shoulder-sling 64 is then placed over the user's shoulder and is gripped at loop 20 as shown in FIG. 11. As shown, shoulder-sling 64 makes wide contact with bag handles 38, and has a smooth surface, thereby preventing tearing of bags 40. Regardless of whether gripped by the wrist or hand, the smooth surface rests ergonomically on the user, making contact with the most skin in the most comfortable way. This functionality results from the half-twists in loops 20, 22.

Figure 13:
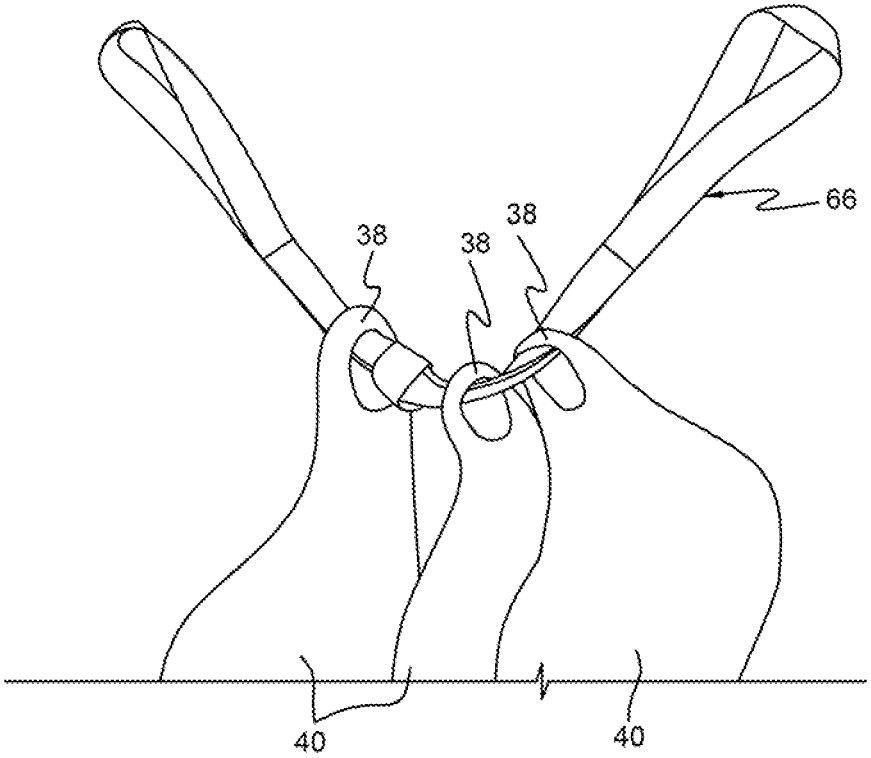
FIG. 13 is a side view of the back-sling extended through aligned grocery bag handle openings.
Figure 14:
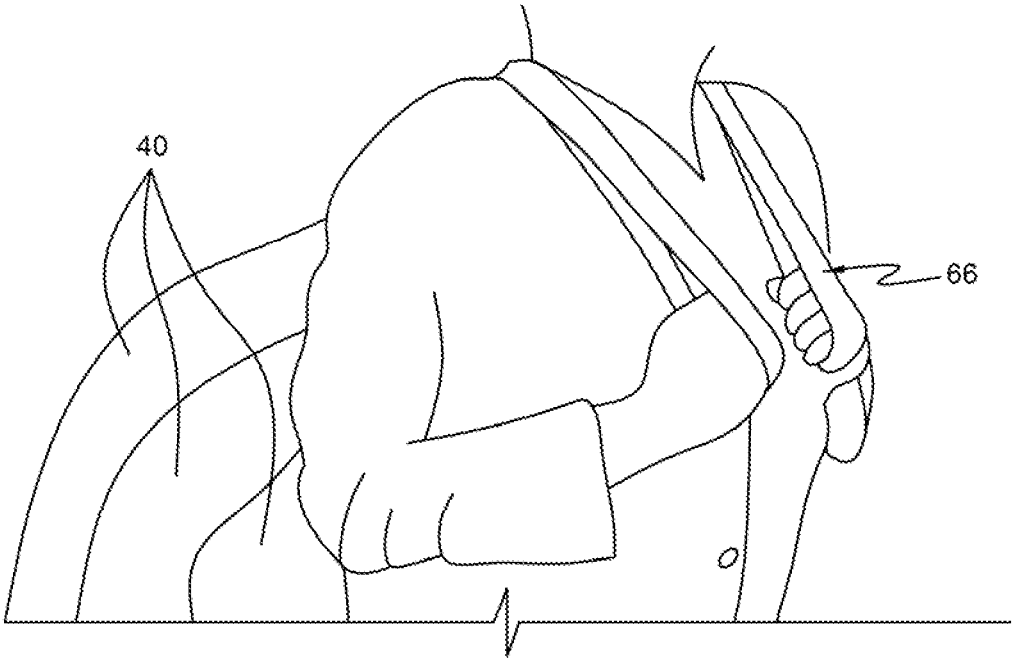
FIG. 14 is a view of the back-sling in use.
Figure 12:
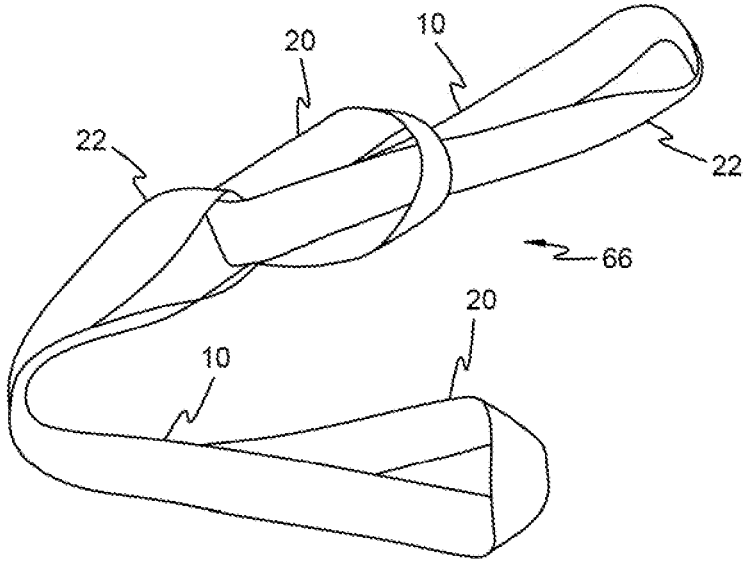
FIG. 12 is a view of two slings being configured into a back-sling for use with the grocery bags.

Back-sling 66 is shown in FIGS. 12-14. Two slings 10 are used to form back-sling 66. First, a loop 20 on a first sling is passed though loop 22 on a second sling. Then first sling loop 20 is passed through first sling loop 22 to secure the first and second slings together and form elongate back-sling 66. Then back-sling 66 is extended through the aligned handles 38 of one or more grocery bags 40. The bags are then placed over the user's back and is gripped by a loop at either end of back sling 66 as shown in FIG. 14.

While the above disclosure uses the flexible sling to carry grocery bags as an example, the sling can be used to assist in holding bags of any kind having handles or any other objects having a handle or similar projection.

Uses other than supporting loads are also contemplated, such as securing a user's grip on safety support bars and handles found in trains, buses and like public transportation vehicles. This allows users to support themselves by the wrist, avoiding tiring out the small muscles and ligaments of the hand during extended travel. This also prevents the user from having to maintain long contact with potentially unclean surfaces found in public transportation vehicles.

It will be appreciated by persons skilled in the art that the present disclosure is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the disclosure.

All references cited herein are expressly incorporated by reference in their entirety. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. A flexible folding sling for carrying and transporting at least one bag or similar object, each of the at least one bag having a handle, the flexible folding sling comprising:

a single continuous one-piece flexible elongate preform strap having first and second ends and a strap center located at a midpoint between the first and second ends, each of the first and second ends folded inward toward the strap center and fixedly attached to the strap center to form respective first and second loops, wherein each of the first and second loops has a half-twist such that each of the first and second loops is a tear-shaped Mobius loop, wherein the first and second loops are provided with a securing member for releasably securing the first loop to the second loop, wherein the securing member includes a hook fastener patch on a side of the first loop and a loop fastener patch on a side of the second loop, with one of the hook fastener patch and the loop fastener patch facing toward the strap center and the other of the hook fastener patch and the loop fastener patch facing away from the strap center, and wherein the hook fastener patch is centered at an apex of the first loop and the loop fastener patch is centered at an apex of the second loop.

2. The flexible folding sling of claim 1, wherein the hook fastener patch and the loop fastener patch are approximately equal in size.

3. The flexible folding sling of claim 2, wherein the strap has a substantially uniform width along the entire length of the strap.

4. The flexible folding sling of claim 3, wherein the flexible folding sling is configurable as a hand-sling and a shoulder-sling.

5. A hand-sling for carrying and transporting at least one bag or similar object, each of said at least one bag having a handle, the hand-sling comprising the flexible folding sling of claim 1, wherein the strap has a width and a length such that the strap extends through each of the handles of the at least one bag, wherein the first and second loops are releasably secured together by the hook fastener patch and the loop fastener patch.

6. The hand-sling of claim 5, wherein the hand-sling has a top opening with a top opening axis and a bottom opening with a bottom opening axis, each of the handles of the at least one bag is captured in the bottom opening so that each of the handles is proximate the strap center and wherein the top opening axis and the bottom opening axis are offset from each other by approximately 90 degrees.

7. The hand-sling of claim 6, wherein the top opening has a concave interior engagement surface formed by an inner surface of a rounded end of the first loop, the concave interior engagement surface adapted to conform to a wrist of a user.

8. The hand-sling of claim 7, wherein a bottom portion of the bottom opening has a capture channel, the capture channel configured and dimensioned to orient each of the handles of the at least one bag such that multiple bags are maintained in a single-file bag group.

9. The hand-sling of claim 8, wherein the strap has a substantially uniform width along the entire length of the strap.

10. A shoulder-sling for carrying and transporting at least one bag or similar object, each of said at least one bag having a handle, the shoulder-sling comprising the flexible folding sling of claim 1, wherein the strap has a width and a length such that the strap extends through each of the handles of the at least one bag, wherein the first loop is passed through the second loop to capture each of the handles of the at least one bag.

11. A back-sling for carrying and transporting at least one bag or similar object, each of said at least one bag having a handle, the back-sling comprising first and second flexible folding slings of claim 1, wherein the first loop of the first flexible folding sling is passed through the second loop of the second flexible folding sling and the first loop of the first flexible folding sling is passed through the second loop of the first flexible folding sling.

12. A method of carrying and transporting at least one bag or similar object, each of said at least one bag having a handle, the method comprising:

extending the strap of the flexible folding sling of claim 1 through each of the handles of the at least one bag; and releasably securing the first and second loops together with the hook fastener patch and the loop fastener patch.

13. The method of claim 12, wherein the flexible folding sling has a top opening with a top opening axis and a bottom opening with a bottom opening axis, each of the handles of the at least one bag is captured in the bottom opening so that each of the handles is proximate the strap center and wherein the top opening axis and the bottom opening axis are offset from each other by approximately 90 degrees.

14. The method of claim 13, wherein the top opening has a concave interior engagement surface formed by an inner surface of a rounded end of the first loop, the concave interior engagement surface adapted to conform to a wrist of a user.

15. The method of claim 14, wherein the strap has a substantially uniform width along the entire length of the strap.

16. A flexible folding sling for carrying and transporting at least one bag or similar object, each of the at least one bag having a handle, the flexible folding sling comprising:

a flexible elongate preform strap having first and second ends and a strap center located at a midpoint between the first and second ends, each of the first and second ends folded inward toward the strap center and fixedly attached to the strap center to form respective first and second loops, wherein each of the first and second loops has a half-twist such that each of the first and second loops is a tear-shaped Mobius loop, wherein the first and second loops are provided with a securing member for releasably securing the first loop to the second loop, wherein the securing member includes a hook fastener patch on a side of the first loop and a loop fastener patch on a side of the second loop, with one of the hook fastener patch and the loop fastener patch facing toward the strap center and the other of the hook fastener patch and the loop fastener patch facing away from the strap center, and wherein the hook fastener patch is centered at an apex of the first loop and the loop fastener patch is centered at an apex of the second loop.

17. The flexible folding sling of claim 16, wherein the hook fastener patch is substantially the same size as the loop fastener patch.

18. A hand-sling for carrying and transporting at least one bag or similar object, each of said at least one bag having a handle, the hand-sling consisting of a flexible folding sling comprising:

a single continuous one-piece flexible elongate preform strap having first and second ends and a strap center located at a midpoint between the first and second ends, each of the first and second ends folded inward toward the strap center and fixedly attached to the strap center to form respective first and second loops, wherein each of the first and second loops has a half-twist such that each of the first and second loops is a tear-shaped Mobius loop, wherein the first and second loops are provided with a securing member for releasably securing the first loop to the second loop, wherein the securing member includes a hook fastener patch on a side of the first loop and a loop fastener patch on a side of the second loop, with one of the hook fastener patch and the loop fastener patch facing toward the strap center and the other of the hook fastener patch and the loop fastener patch facing away from the strap center, wherein the hook fastener patch is centered at an apex of the first loop and the loop fastener patch is centered at an apex of the second loop, wherein the strap has a width and a length such that the strap extends through each of the handles of the at least one bag, wherein the first and second loops are releasably secured together by the hook fastener patch and the loop fastener patch, wherein the hand-sling has a top opening with a top opening axis and a bottom opening with a bottom opening axis, each of the handles of the at least one bag is captured in the bottom opening so that each of the handles is proximate the strap center, and wherein the top opening axis and the bottom opening axis are offset from each other by approximately 90 degrees.

* * * * *